United States Patent [19]

Fish et al.

[11] 4,162,071

[45] Jul. 24, 1979

[54] GOLF TEE

[76] Inventors: Barry M Fish; Alfred G. Ward, both of 8131 Yonge St., Thornhill, Ontario, Canada, L3T 2C6

[21] Appl. No.: 828,485

[22] Filed: Aug. 29, 1977

[51] Int. Cl.[2] ..... A63B 57/00

[52] U.S. Cl. ..... 273/33; 273/187 R

[58] Field of Search ..... 273/33, 202, 203, 204, 273/205, 207, 208, 209, 210, 211, 212; D9/54–65; 220/DIG. 13, DIG. 14, DIG. 22; 229/22; 215/1

[56] References Cited

U.S. PATENT DOCUMENTS

| | | | |
|---|---|---|---|
| D50,010 | 12/1916 | Bell | D9/56 |
| D106,226 | 9/1937 | Wildman | D9/55 |
| 1,551,207 | 8/1925 | Nial et al. | 273/211 |
| 1,717,318 | 6/1929 | Pugn | 273/208 |

FOREIGN PATENT DOCUMENTS

| | | | |
|---|---|---|---|
| 984176 | 7/1951 | France | 215/1 R |
| 15314 | of 1911 | United Kingdom | 273/33 |
| 155185 | 12/1920 | United Kingdom | 273/208 |

*Primary Examiner*—Richard C. Pinkham
*Assistant Examiner*—T. Brown
*Attorney, Agent, or Firm*—Howard I. Schuldenfrei

[57] ABSTRACT

An improved golf tee is provided having a generally truncated pyramidal shape, ascending transparent side walls, and a fluted cylindrical member mounted on the truncation thereof having a free upstanding open end on which a golf ball may be removably mounted. According to one embodiment of the invention, the improved golf tee may be elevated above the playing surface on a plurality of legs. According to another embodiment of the invention, a directional compass may be mounted in the improved tee in a plane substantially normal to the fluted cylindrical member thereof.

4 Claims, 6 Drawing Figures

GOLF TEE

BACKGROUND OF THE INVENTION

This invention relates generally to golfing devices, and more particularly to an improved golf tee from which a golf ball may be driven.

Conventional golf tees which must be ground driven prior to use have limited utility and are generally impractical for practice purposes, for instance at indoor and outdoor "driving ranges". Additionally, these conventional tees neither include functional means whereby a novice golfer may suitably align his stance relative to the teed golf ball, nor do they include functional means whereby a golfer may gauge the desired direction of the golf ball relative to his stance.

Accordingly, the instant invention provides an improved golf tee having a novel construction which overcomes the disadvantages of the aforesaid conventional golf tees.

SUMMARY OF THE INVENTION

Generally speaking, in accordance with the invention, an improved golf tee is provided which has a generally truncated pyramidal shape, ascendant transparent side walls, and a fluted cylindrical member mounted on the truncation thereof having a free upstanding open end on which a golf ball may be removably mounted. Respective bottom edges of the side walls form a polygon having linear edges along which a golf ball mounted on the improved tee may be sighted.

According to one embodiment of the invention, the improved golf tee may be elevated upon removably mountable legs. This embodiment has particular utility on rough terrain where a flat setting for the improved tee is not otherwise obtainable.

According to another embodiment of the invention, a directional compass is removably mounted in the base of the improved golf tee in a plane substantially normal to the fluted cylindrical member thereof. This feature provides mechanical means whereby the golfer can align his stance with the hole which is to be driven too.

Accordingly, it is an object of this invention to provide an improved golf tee which may be mounted on hard terrain with facility.

Another object of the invention is to provide an improved movable golf tee suitable for outdoor and indoor driving range use.

A further object of the invention is to provide an improved golf tee which may be elevated according to the terrain on which the ball is played.

Still another object of the invention is to provide an improved golf tee including means whereby a golfer may determine his alignment with a golf ball for suitably addressing the golf ball relative to the direction of the objective hole.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWING

For a fuller understanding of the invention, reference is had to the following description taken in connection with the accompanying drawing, in which.

DESCRIPTION OF THE PREFERRED EMBODIMENTS

Figure 1:
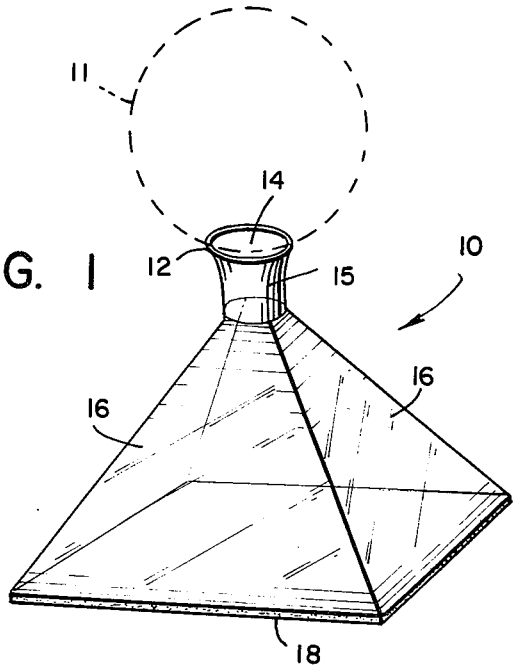
FIG. 1 is a perspective view of an embodiment of an improved golf tee constructed according to the instant invention.
Figure 4:
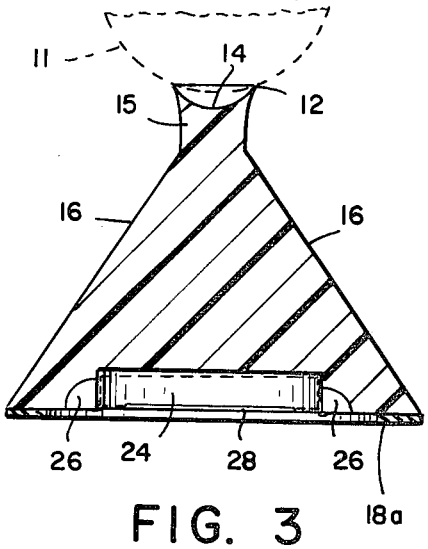
FIG. 4 is a cross-sectional view taken along line 4—4 of FIG. 3.

Referring generally to the drawing wherein like numbers represent identical elements, and to FIG. 1 in particular wherein an improved golf tee, constructed according to the invention, generally numbered 10 has a generally pyramidal shape defined by plural transparent ascendent side panels 16 mounted on a polygonal planar base 18. Side panels 16 are uniformly bevelled below their respective peaks, lacking ascendent vertices, thereby defining a truncation in the general pyramidal shape thereof.

Mounted on the truncation defined by side panels 16 is a fluted cylindrical member 15 having an upstanding free end in which an outwardly opening mouth 14 is provided and surrounded by a lip 12. As best seen in FIG. 1, a golf ball 11 which is to be addressed is mounted on mouth 14 and stabilized thereon by lip 12.

Referring now to FIGS. 2–5 an embodiment of the invention which is elevatable on legs 20 above the playing surface may be seen. The improved golf tee 10 may be provided with a base member **18*a* having downwardly opening frusto-conical apertures 30 approximate each vertex thereof, each aperture 30 being defined by an upwardly tapered sidewall 32. Legs 20 are concomitantly provided with upwardly tapered upper ends 34 introduceable into respective apertures 30 until legs 20 are stabley vertically engaged therein. This tapered aperture and end arrangement provided respectively in base 18*a* and legs 20 provided for mating engagement of legs 20 in base 18*a***, substantially eliminating the type of horizontal movement of the mounted legs which causes wabbling.

Figure 3:
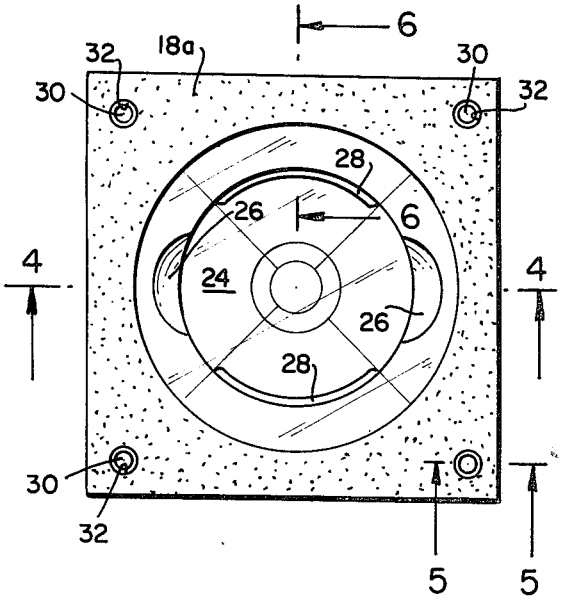
FIG. 3 is a bottom plan view of the embodiment seen in FIG. 2.
Figure 5:
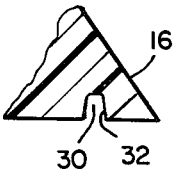
FIG. 5 is a sectional view taken along line 5—5 of FIG. 3.
Figure 2:
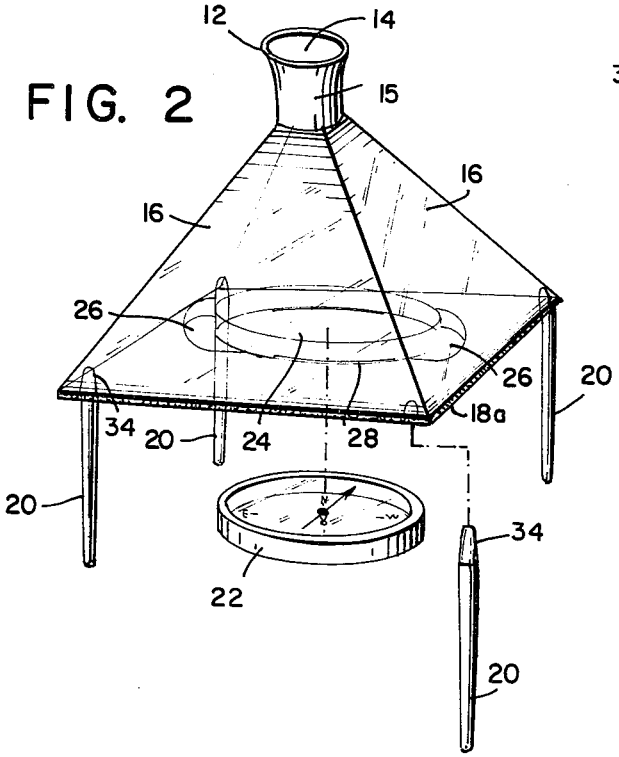
FIG. 2 is a partially exploded perspective view of an elevatable embodiment of the invention in which a directional compass may be removably mounted.
Figure 6:
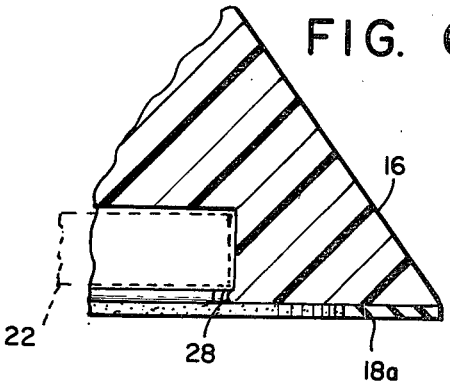
FIG. 6 is a sectional view taken along line 5—5 of FIG. 3.

As further seen in these Figures, base **18*a* may be provided with a central slot 24 in which a directional compass 22 may be removably mounted. A pair of oppositely disposed symmetrical resilient ribs may be provided along the edge of slot 24 for releasably supporting compass 22 therein, as best seen in FIGS. 2,3 and 6. As particularly shown in FIG. 2, compass 22 may be introduced upwardly through slot 24 until the bottom edge thereof overlies ribs 28. A pair of oppositely disposed symmetrical finger slots 26 adjoin slot 24 for facilitating introduction and removal of compass 22** therefrom.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved golf tee comprising a generally pyramidally shaped housing including a plurality of ascendant transparent generally triangular side walls, each of said side walls having first and second oblique edges adjoining another of said plurality of said walls, each of said plurality of said walls being uniformly bevelled below the upper vertex thereof and thereby defining a truncation in said housing, a fluted cylindrical member mounted on said truncation in said housing having an upstanding free end on which a golf ball may be removably mounted, a planar base member substantially parallel to said truncation therein, and a plurality of leg members releasably mountable on said base of said housing for elevating said housing above a playing surface.

2. The improved golf tee as claimed in claim 1, said fluted cylindrical member including a downwardly opening mouth in the free end thereof on which a golf ball may be perched, and a continuous lip surrounding said mouth.

3. The improved golf tee as claimed in claim 1, said plurality of leg members having tapered upper ends, and said base of said housing having a corresponding plurality of frustoconical apertures in which said upper ends of said leg members may be removably matingly engaged.

4. An improved golf tee as claimed in claim 1, wherein said planar base member has a polygonal configuration.

* * * * *